US005510760A

United States Patent [19]

Marcou et al.

[11] Patent Number: 5,510,760

[45] Date of Patent: Apr. 23, 1996

[54] GROUND FAULT INTERRUPTER WIRING DEVICE WITH IMPROVED LATCHING AND ACTUATING COMPONENTS

[75] Inventors: Jean-Claude Marcou, DeWitt; Thomas N. Packard, Syracuse; David A. Finlay, Marietta; Patrick J. Murphy, Marcellus, all of N.Y.

[73] Assignee: Pass & Seymour, Inc., Syracuse, N.Y.

[21] Appl. No.: 327,610

[22] Filed: Oct. 24, 1994

[51] Int. Cl.[6] ..... H01H 73/00

[52] U.S. Cl. ..... 335/18; 361/51

[58] Field of Search ..... 335/18; 361/41–50

[56] References Cited

U.S. PATENT DOCUMENTS 4,630,015 12/1986 Gernhardt et al. ..... 335/18

5,223,810 6/1993 Van Haaren ..... 335/18

*Primary Examiner*—Lincoln Donovan

*Attorney, Agent, or Firm*—Charles S. McGuire

[57] ABSTRACT

A ground fault interrupter (gfi) wiring device includes a latch member having integral abutment, latching and spring portions. In the preferred embodiment, the latch member is formed from a unitary blank of springy sheet metal, the spring portion being a leaf spring formed at one end and biasing the latch member to a latching position to maintain the moveable contact(s) in circuit-making relation with the fixed contact(s) of the device. The latch member is released to permit circuit-breaking movement of the moveable contact(s) by a solenoid having an armature with a relatively enlarged head portion to enhance speed of operation. Optionally, a spring may be provided to maintain the otherwise freely-slidable armature with its end portion in spaced relation to the latch member abutment portion so that the armature gains momentum before contacting the abutment portion to effect unlatching movement of the latch member.

41 Claims, 14 Drawing Sheets

GROUND FAULT INTERRUPTER WIRING DEVICE WITH IMPROVED LATCHING AND ACTUATING COMPONENTS

BACKGROUND OF THE INVENTION

The present invention relates to the class of electrical wiring devices known as ground fault circuit interrupters (gfi) and, more specifically, to improved means for releasably retaining the spring biased, moveable contacts of such devices in circuit-making condition during normal operation and effecting movement of such contacts to circuit-breaking condition in response to potentially hazardous malfunctions, as well as to improvements in solenoid actuating means for the releasable retaining means of such devices.

Typical gfi wiring devices include means for releasably latching moveable contacts in a first position against a biasing force urging the contacts toward movement to a second position. The latching means are released to permit movement of the contacts by movement of a solenoid armature in response to an imbalance in current flow in the hot and neutral conductors of the circuit in which the gfi device is connected. It is, of course, desirable that the components be as simple and few in number as possible, consistent with durability and reliability of operation, and that the tripping and circuit-breaking operation occur rapidly and reliably upon sensing of the fault condition.

It is a principal object of the present invention to provide a gfi wiring device having improved, releasable latching means for maintaining moveable contacts in a first position and permitting movement to a second position upon solenoid-actuated tripping of the latching means.

Another object is to provide releasable latching means for the moveable contacts of a gfi receptacle having fewer component parts than conventional latching means, while maintaining a high degree of reliability.

A further object is to provide means for latching and releasing moveable contacts of a gfi wiring device including improved, fast-acting, highly reliable solenoid actuating means.

Other objects will in part be obvious and will in part appear hereinafter.

SUMMARY OF THE INVENTION

Conventional gfi devices include one or more sets of corresponding fixed and moveable contacts, latching means for maintaining the corresponding contacts in mutually engaged, circuit-making relation and means for releasing the latching means to permit movement of the moveable contact(s) into spaced, circuit-breaking relation to the fixed contact(s) in response to a sensed fault condition. The latching means is often in the form of a manually engageable reset button having a stem with a shoulder, or the like, releasably engageable with a corresponding shoulder or edge portion on a latch member. The stem is moveable along its longitudinal axis, and the latch member is also moveable in this direction, as well as in a perpendicular direction.

In the gfi device of the present invention, the moveable switch contacts are carried by a block member which rests upon and is moveable in the axial direction of the reset member stem with the latch member. When the stem shoulder is engaged with the latch member, a first spring moves the stem axially, together with the latch and block members, to a position wherein the moveable contacts engage the fixed contacts of the device. One or more second springs, weaker than the first spring, urge the moveable contacts, together with the block and latch members, toward movement away from the fixed contacts.

Upon sensing of a fault condition, i.e., in response to an imbalance of current flow through the hot and neutral lines of the circuit in which the device is connected, the coil of a solenoid is energized to cause movement of the solenoid armature into contact with an abutment portion of the latch member. This moves the latch member perpendicularly to the stem axis, thereby releasing the latching portion of the latch member from the stem shoulder, permitting the second spring(s) to move the moveable contacts out of engagement with the fixed contacts to break the circuit.

The solenoid coil is deenergized when the circuit is broken, whereby the armature no longer applies a force to the abutment portion of the latch member. Third spring means then move the latch member in the opposite direction from that in which it is moved by the solenoid armature so that the latching portion is in position to be again engaged by the stem shoulder upon manual depression of the reset button against the biasing force of the first spring.

In a preferred embodiment, the latch member is a unitary element, stamped and formed from sheet metal to include the abutment portion, the latching portion, and an integral, leaf-type spring. In another embodiment, the leaf spring is replaced by a coil spring mounted upon the latch member. The latch-releasing movement of the solenoid armature is enhanced in either or both of two ways, namely, by an enlarged head portion on the armature which is acted upon by the flux field of the coil, and by a separate spring maintaining the contact end portion (opposite the head portion) of the armature in spaced relation to the abutment portion of the latch member prior to energization of the coil.

DETAILED DESCRIPTION

Figure 1:
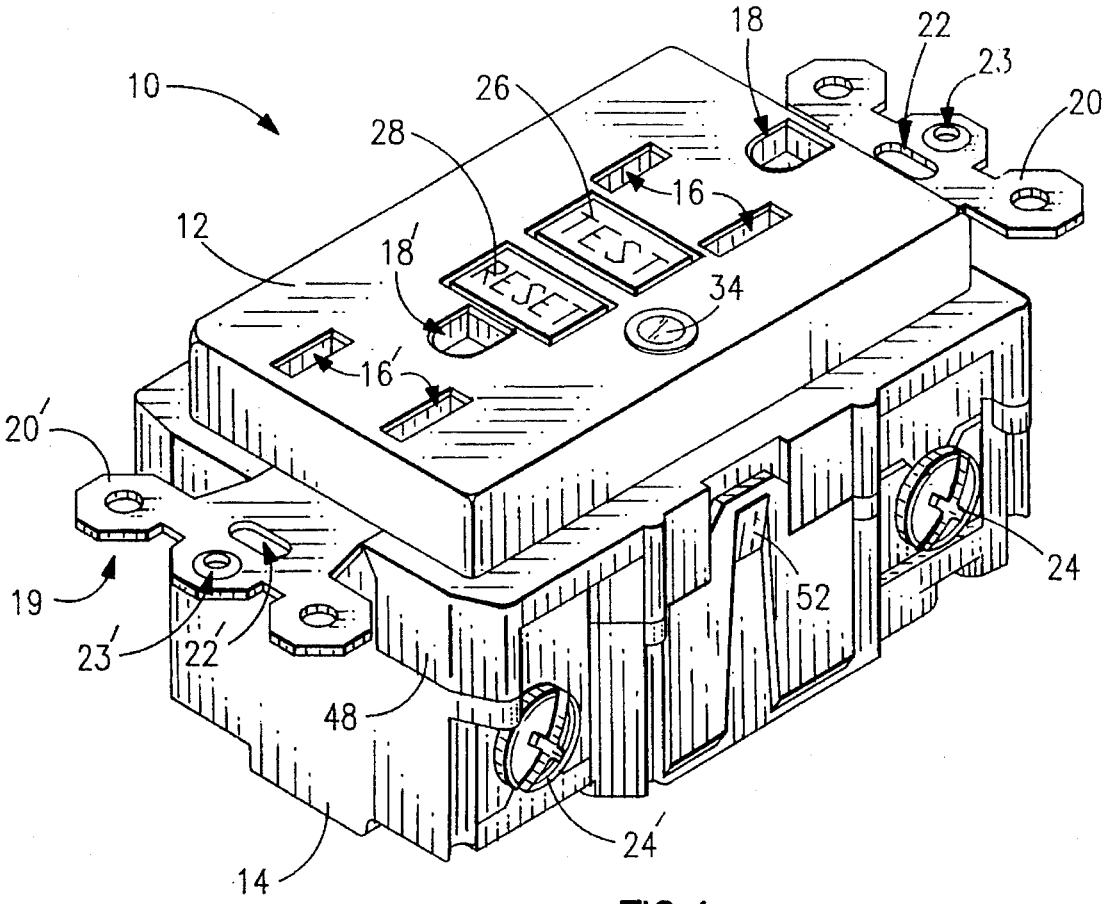
FIG. 1 is a perspective view of a fully assembled ground fault interrupter wiring device, namely, a duplex electrical receptacle, embodying features of the invention.
Figure 2:
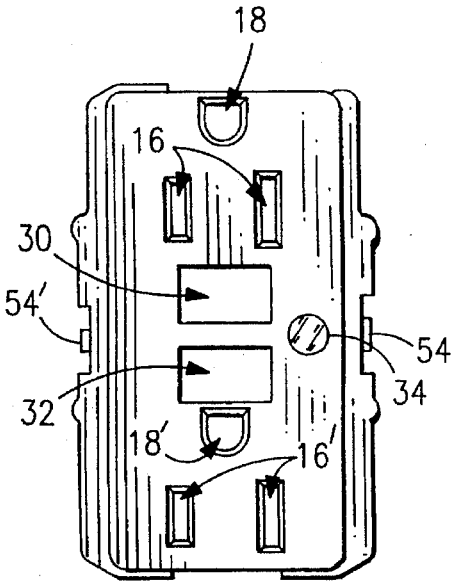
FIG. 2 is a top plan view of the front section or cover of the housing of the receptacle of FIG. 1.

Referring now to the drawings, in FIG. 1 is shown a fully assembled wiring device 10 typical of the class of devices embodying the features of the present invention. Device 10 is a ground fault interrupter (hereinafter abbreviated as "gfi"), duplex, two-pole, electrical receptacle, although it will be understood that certain features of the inventions may be incorporated in other gfi devices, including circuit breaker types requiring only one pole or multiphase devices requiring three or more poles.

As is typical of such devices, components are enclosed in a space defined by housing means comprising a cover or front section 12 and a body or rear section 14. As will later become apparent, the front and rear sections are retained in mutually secured relation by both releasable and permanent securing means. A first pair of through openings 16 is provided in front section 12 to receive a pair of blades of a standard electrical plug, together with a third opening 18 for receiving the ground prong of plugs equipped therewith. A second set of through openings 16', 18' is provided to accept a second plug.

A metal grounding and mounting strap, denoted generally by reference numeral 19, includes a central portion, not seen in FIG. 1, disposed within the enclosed space defined by housing sections 12 and 14, and mounting ears 20, 20' extending outwardly from opposite ends of device 10. Ears 20, 20' include the usual openings 22, 22', respectively, for passage of screws to mount device 10 in a conventional wall box, as well as threaded openings 23, 23' to receive screws for mounting a conventional wall plate (not shown). Also seen in FIG. 1 are a pair of screws 24, 24' for electrical connection of the bare ends of conductors on the line and load sides of the device; as will be seen later, a second pair of screws are provided for connection of conductors on the opposite side of device 10.

A pair of rectangular buttons 26 and 28, labeled "Test" and "Reset", respectively, are positioned in respective, through openings 30 and 32 in front housing section 12. Transparent lens 34 covers an opening in front section 12 for viewing of an operational-indicating LED, as explained later in more detail. Another feature of particular interest in connection with front section 12 is the two rows of four post members each, all indicated by reference numeral 36, extending rearwardly (i.e., in the direction of rear housing section 14 in the assembled condition) along opposite sides of the front section. As will be seen, these post members 36 provide an important function in the final assembly of device 10.

Figure 3:
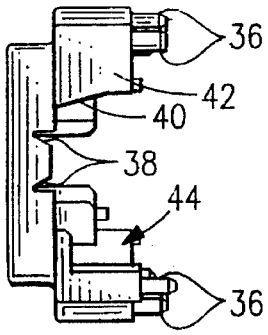
FIGS. 3 and 3*a* are end elevational views of the front housing section, as seen from the top and bottom, respectively, of FIG. 2.
Figure 3A:
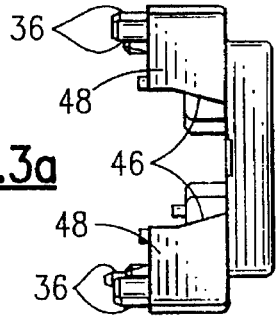
Figure 4:
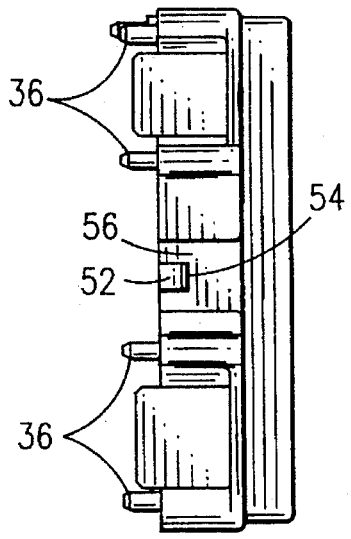
FIG. 4 is a side elevational view of the front housing section, the appearance being the same from both sides.
Figure 5:
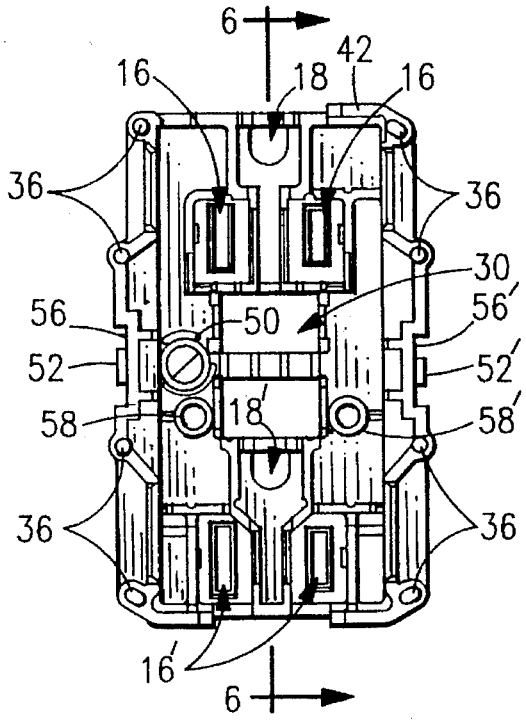
FIG. 5 is a bottom plan view of the front housing section.
Figure 6:
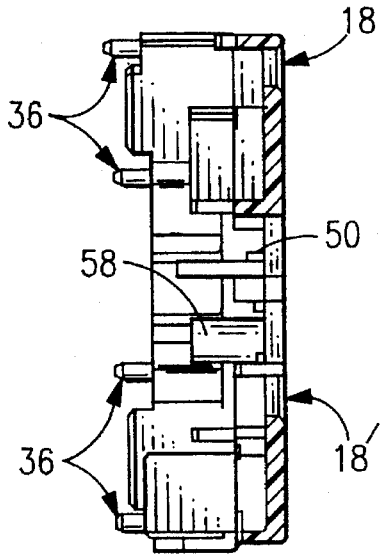
FIG. 6 is a side elevational view in section on the line 6—6 of FIG. 5.
Figure 7:
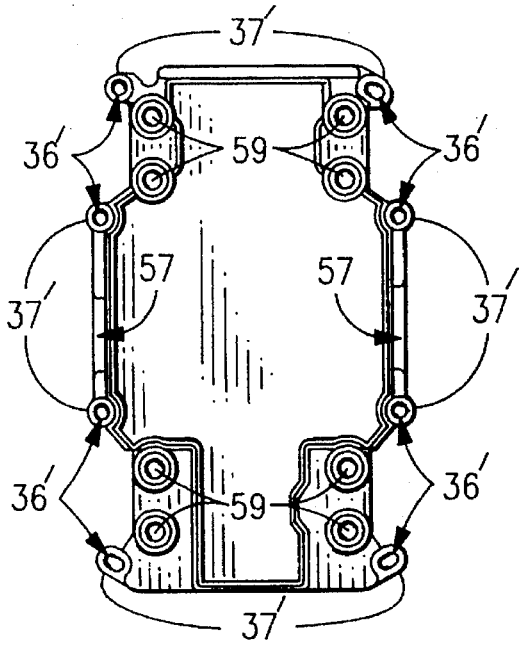
FIG. 7 is a top plan view of the rear section or body of the housing of the receptacle of FIG. 1.

The appearance of front section 12 is similar at its opposite ends, as seen in FIGS. 3 and 3*a*. The upper end, i.e., the end adjacent opening 18, includes a pair of notches 38 for accommodating edges of one of the grounding terminals on the mounting strap. Edge 40 of end wall 42 mates closely with a corresponding end wall edge of rear section 14, and open area 44 provides access to the screw for connecting the bare end of a ground wire to a depending tab on mounting strap 19, as seen later. Edges 46 of wall portions 48 at the lower end mate closely with corresponding edges of rear section 14.

Circular wall portion 50 surrounds the previously mentioned LED in the assembled condition. Tapered lugs 52, 52' extend outwardly from central portions of the outer surfaces on opposite of the front housing section. Lugs 52, 52' provide stepped shoulders 54, 54' and taper inwardly to meet surfaces 56, 56' at the edge which mates with rear section 14. Circular wall portions, termed towers and denoted by reference numerals 58, 58' extend rearwardly from the inside of the front wall of front section 12 to provide abutment means for a pair of coil springs described hereinafter.

Rear housing section 14 is shown in greater detail in FIGS. 7–10. As in the case of front section 12, rear section 14 is preferably formed as a unitary, molded plastic part. The rear or outer surface of rear section 14, i.e., the surface which is exposed in the assembled condition, is seen in FIG.

Figure 10:
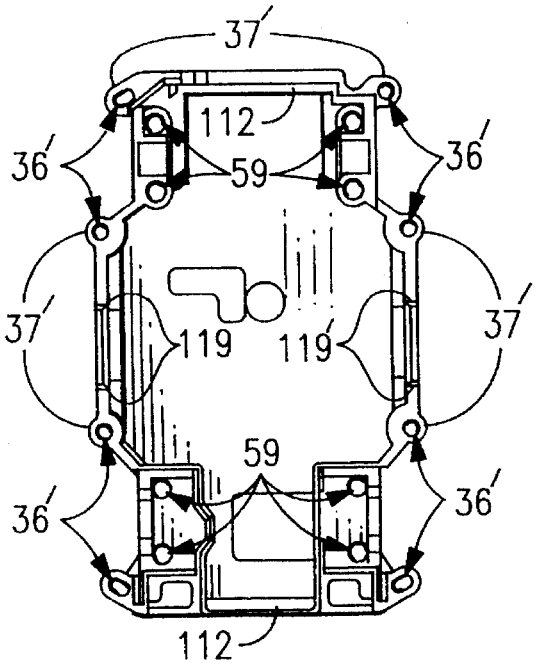
FIG. 10 is a bottom plan view of the rear housing section.

7, and the inner surface, which forms a portion of the enclosed space defined by the assembled housing sections, is seen in FIG. 10. Through openings 36' in portions 37' of rear sections 14 are positioned complementary to posts 36 of front section 12 so that, as the front and rear sections are moved linearly into mating engagement, posts 36 pass through openings 36'. During such relative movement of the housing sections, tapered lugs 52, 52' on front section 12 outwardly deflect resilient tabs 53, 53' on rear section 14 until stepped shoulders 56, 56' on the lugs clear edges 55, 55' of openings 57, 57' in tabs 53, 53'. When this occurs, the natural resilience of tabs 53, 53' causes them to return to their original positions, wherein stepped shoulders 56, 56' abut edges 55, 55' of openings 57, 57'. The housing sections are thus retained in mating engagement by the snap fit means of the lugs and tabs, such engagement being releasable by using a tool to deflect tabs 53, 53' outwardly to permit passage of lugs 52, 52' past edges 55, 55'.

Figure 8:
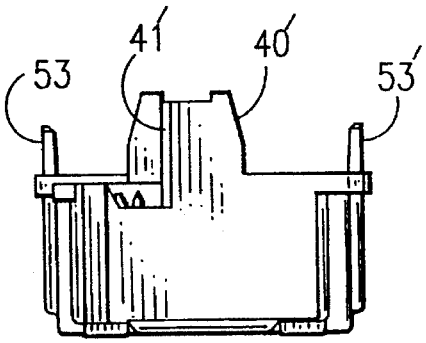
FIGS. 8 and 8*a* are end elevational views of the rear housing section, as seen from the top and bottom, respectively, of FIG. 7.
Figure 8A:
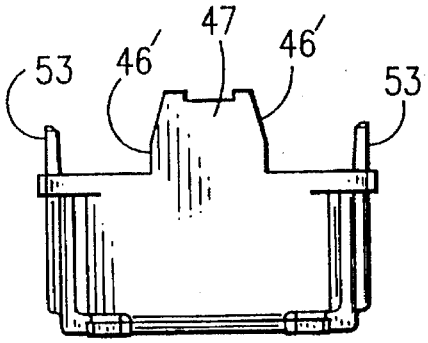
Figure 9:
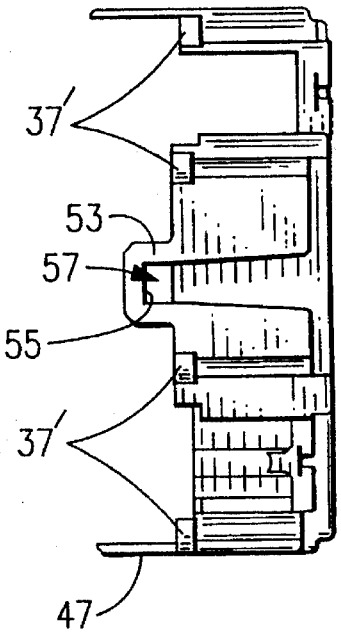
FIG. 9 is a side elevational view of the rear housing section, the appearance being the same from both sides.

When the housing sections are in mutually mating engagement, opposing edges of side and end wall portions thereof abut one another to provide essentially full enclosure of the space wherein the other elements of gfi device 10 are positioned. For example, edge 40 at the upper end of front housing section 12 (FIG. 3) abuts edge 40' of rear section 14 (FIG. 8), and edge 41' borders previously mentioned open area 44. Likewise, edges 46 at the opposite end (FIG. 3*a*) abut edges 46' (FIG. 8*a*) and end wall portion 47 of rear housing section 14 fills the space between these abutting edges. Through openings 59 are provided for passage of the ends of conductors to be connected to terminals within the housing, as explained later.

Figure 11:
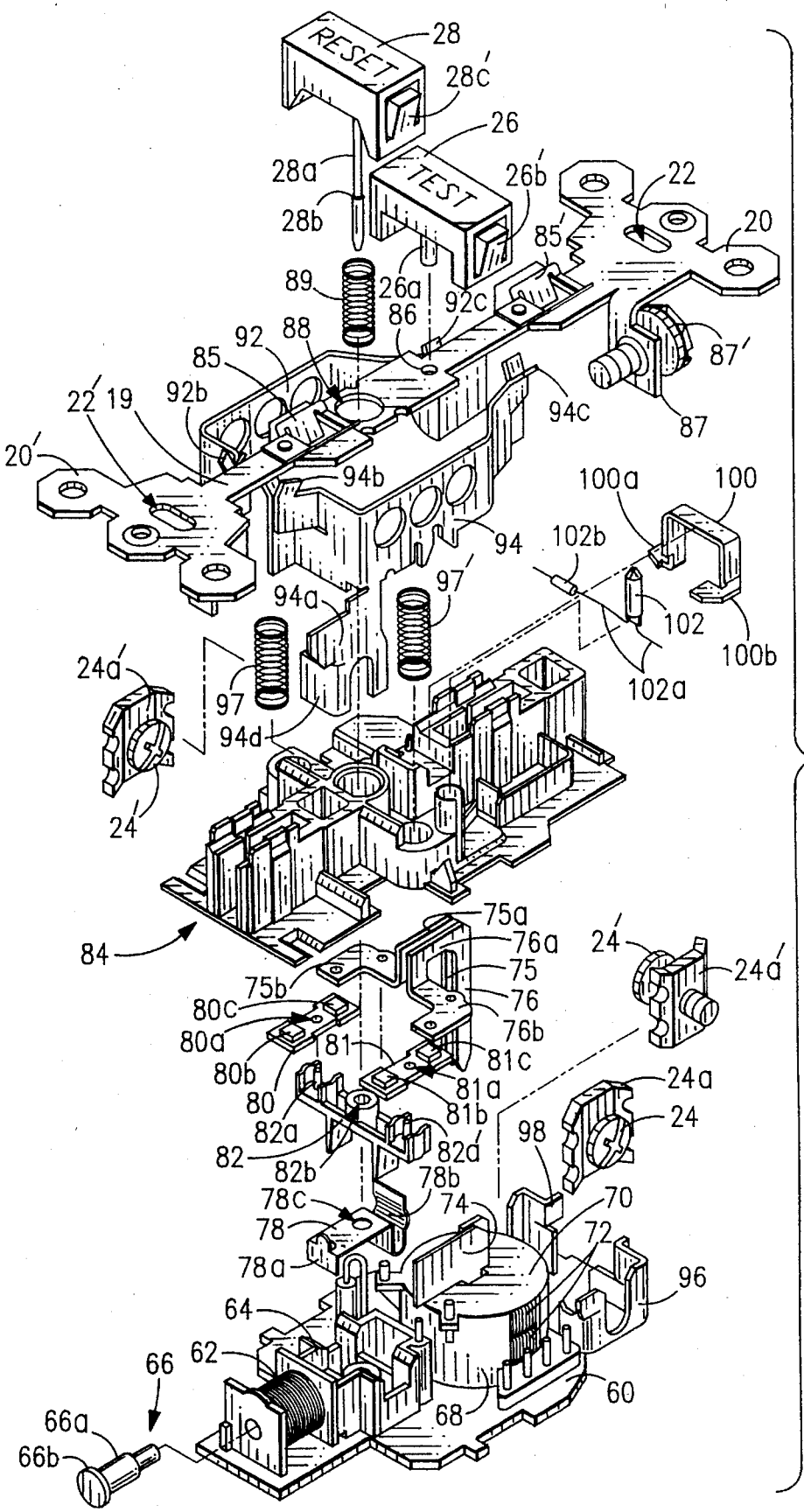
FIG. 11 is an exploded perspective view of components of the GFI device which are configured for automated assembly with the housing sections.

All of the elements which are positioned within the enclosed space defined by housing sections 12 and 14, including the previously mentioned mounting strap 19, test button 26 and reset button 28, are shown in exploded, perspective view in FIG. 11. Further details of construction, assembly and operation of the elements will be provided later herein, but identification of the elements and a general understanding of their interrelationship is facilitated by FIG. 11. Printed circuit board 60 provides a support for solid-state components of the gfi circuitry and includes the usual copper traces interconnecting the components in the required manner. In addition to the electrical and electronic components, certain sub-assemblies are mounted upon board 60.

Solenoid coil 62 is wound on a hollow core portion of plastic support element 64 and stem 66*a* of moveable solenoid armature 66, having enlarged head portion 66*b*, passes loosely through this hollow core. Cylindrical plastic housing 68 and circular plastic cover 70 provide an enclosure for a pair of toroidal cores 72 and associated windings used in sensing an imbalance in current flow through the hot and neutral conductors of device 10 in the usual manner of gfi devices. Wall 74 is formed integrally with cover 70 and provides a dielectric separator for upper portions 75*a*, 76*a* of a pair of conducting posts or strips 75, 76, respectively, which extend through openings in cover 70 and through cores 72. Forward portions 75*b*, 76*b* of strips 75, 76, respectively each carry a fixed contact through which the circuit of the hot and neutral lines is completed. Thus, strips 75 and 76, including their upper and forward portions, form parts of the hot and neutral conductors of the circuit in which gfi device 10 is connected.

Sheet metal member 78, termed a latch spring, has an abutment portion 78*a* at one end, leaf spring 78*b* at the other end, and opening 78*c* in an intermediate portion. When assembled, the U-shaped end of spring 78*b* extends into a cavity of support element 64, and abutment portions 78*a* is positioned for contact by the free end of solenoid armature stem 66*a*. Buss bars 80, 81 are supported on opposite, upper sides of latch block 82 with integral posts 82*a*, 82*a'* of the latch block extending through openings 80*a*, 81*a*, respectively, to provide positive location of the buss bars on the latch block. Buss bar 80 carries spaced contacts 80*b* and 80*c*; buss bar 81 carries spaced contacts 81*b* and 81*c*.

An integral, molded, plastic part, termed a separator and indicated generally by reference numeral 84, includes a plurality of wall portions and openings, the locations and purposes of which are described later. Portions of separator 84 support and laterally constrain mounting strap 19 which is seen in FIG. 11 to include rivet-connected ground contacts 85, 85' for receiving the grounding prongs (extending through openings 18, 18') of electrical plugs connected to device 10. Depending tab 87 has a threaded opening for screw 87' to connect a ground wire to strap 19. Openings 86 and 88 in strap 19 are provided for passage through the strap of pins on test button 26 and reset button 28, respectively. Pin 26*a* is integrally formed in the plastic molding of button 26, and metal pin 28*a*, having shoulder 28*b*, is fixedly secured to the plastic molding of button 28. Coil spring 89 encircles stem 28*a* and has a diameter small enough to pass through opening 88.

Load terminals 92 and 94 are mounted within the housing for connection thereto of the hot and neutral conductors, respectively, on the load side of device 10. Such connection of the neutral conductor may be made to terminal 94 by inserting a bare end of the conductor through either of an appropriate pair of openings 59, and between depending tab 94*a* of terminal 94 and pressure plate 94*a'*; screw 24' passes through an open-ended slot in tab 94*a* and a threaded opening in plate 24*a'*, and is tightened to provide good electrical contact between the conductor and terminal. The hot conductor on the load side is similarly connected to terminal 92 by another screw and pressure plate, not shown in FIG. 11. Such connections are known as "back-wiring". The connections may be alternately made by looping the conductor around the screw between the screw head and the terminal tab. Female contacts 92*b* and 94*b* are positioned to receive the blades of an electrical plug extending through openings 16' in front housing section 12, and contacts 92*c*, 94*c* are positioned to receive the blades of a plug extending through openings 16.

Line terminals 96 and 98 are fixedly connected to circuit board 60 by posts on the terminals extending through openings in the boards and soldered to terminals on the lower side of the board. As best seen with respect to terminal 96, an open-ended slot is provided to receive screw 24, with the head of the screw on one side of the terminal and pressure plate 24*a* on the other side. A bare end of the neutral conductor on the line side of device 10 may be back-wired by inserting through one of openings 59, between plate 24*a* and terminal 96 and tightly urged against the terminal by tightening the screw. The hot conductor on the line side is connected to terminal 98 in like fashion.

Coil springs 97 and 97' pass through respective openings in separator 84 and are compressed between buss bars 80 and 81, and towers 58, 58' on the interior of front housing section 12 when device 10 is fully assembled, as described later. Test blade 100 includes laterally and forwardly extending legs 100*a* and 100*b*, respectively, a medial portion of the blade being positioned for contact by pin 26*a* upon depression of test button 26. LED 102 is positioned within the housing for viewing through previously-mention lens 34; electrical leads 102*a* extend from opposite sides of LED 102, with voltage-dropping resistor 102*b* interposed in one lead, for connection in the circuit in a manner later described.

Figure 12:
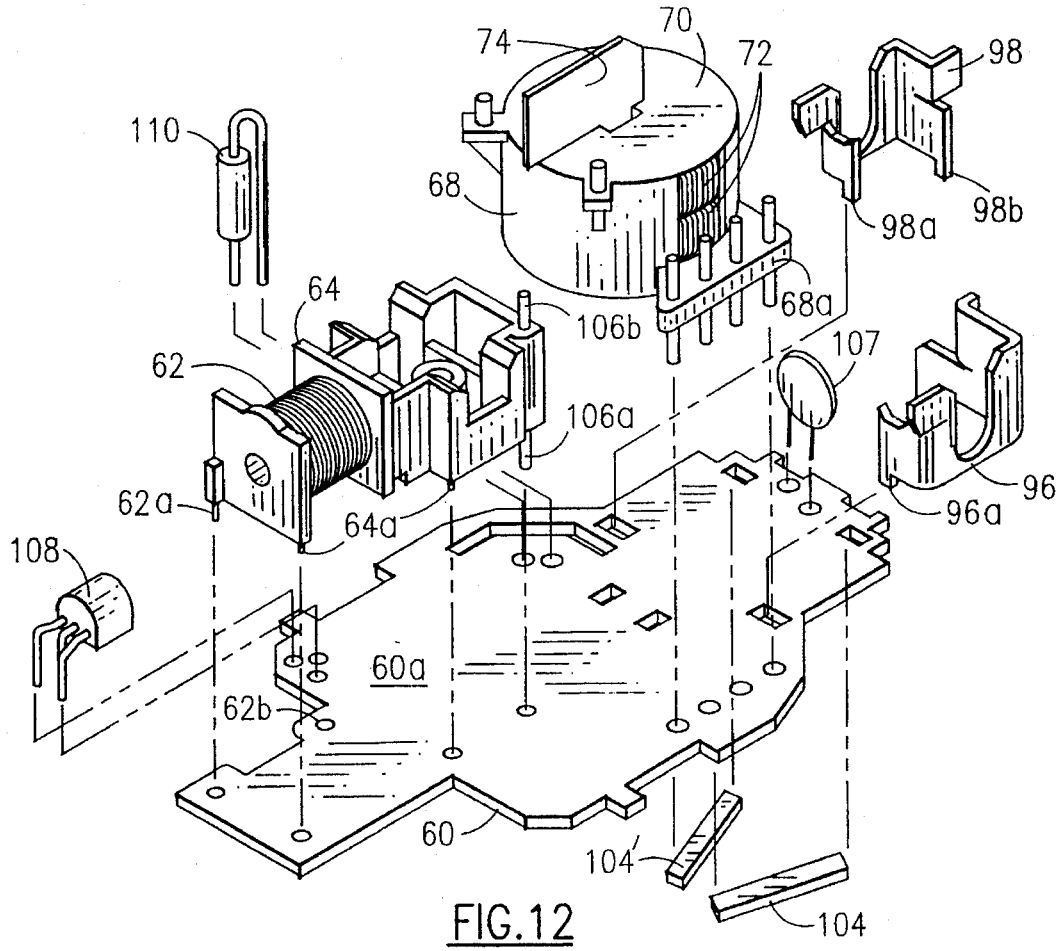
FIG. 12 is a further exploded perspective view of certain of the components shown in FIG. 11.
Figure 13:
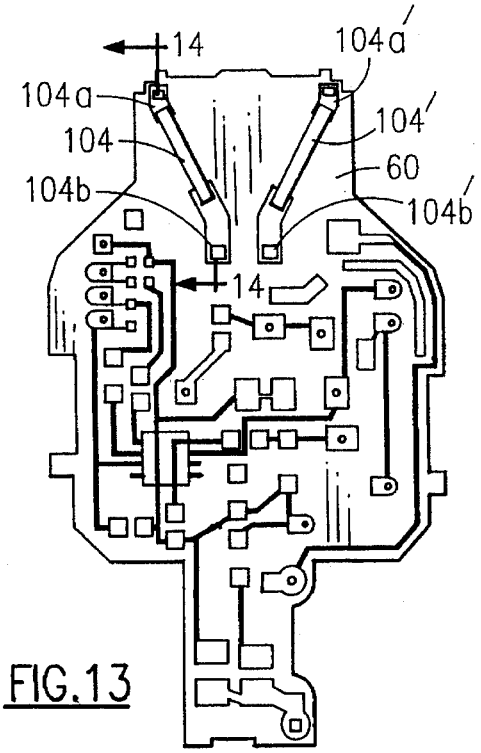
FIG. 13 is a bottom plan view of a printed circuit board, the top of which is seen in FIGS. 11 and 12.
Figure 14A:
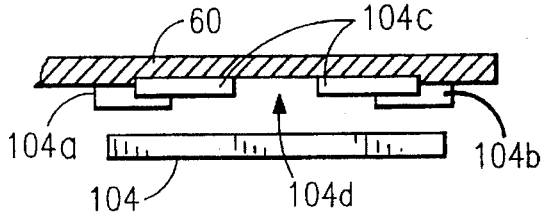
FIGS. 14*a* and 14*b* are fragmentary, enlarged, side elevational views of portions of FIG. 13 illustrating steps in the fabrication of the device.
Figure 14B:
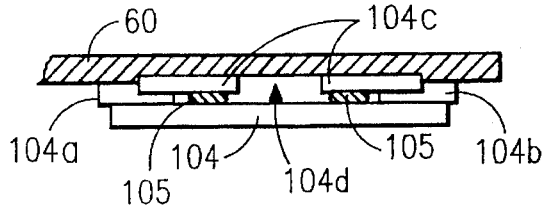

Circuit board 60 and elements mounted thereon are shown in more detail in FIGS. 12–14. Opposite surfaces 60*a* and 60*b* or board 60 are seen in FIGS. 12 and 13, respectively. A plurality of surface-mount-device (SMD) electronic components are attached by a suitable adhesive to surface 60*b* at positions interconnected by preformed copper traces on board 60 to provide portions of the gfi circuitry. Although the circuitry itself is conventional, and therefore not described in detail by way of electrical schematics, or the like, a unique feature is provided by a fabrication technique relating to jumper cables 104, 104' and related portions of the circuit, as shown in FIGS. 14*a* and 14*b*.

Cable 104 connects terminals 104*a* and 104*b*, and cable 104' likewise connects terminals 104*a'* and 104*b'*. Cables 104, 104' are preferably formed by flattening initially round sections of electrical wire on at least one side to provide a flat surface for adhesion to the board by glue dots 105 (FIG. 14*b*). As is the usual practise in construction of circuit boards for gfi devices, terminals 104*a* and 104*b* are connected by a copper trace 104*c*, terminals 104*a'* and 104*b'* being likewise connected. The reason for also connecting these terminals via jumper calxes is to carry relatively high currents between these terminals.

In the present gfi device, trace 104*c* and the trace connecting terminals 104*a'* and 104*b'* are broken, as indicated at 104*d*, prior to mounting of jumper cable 104. This provides an important and useful function in testing the circuitry of device 10. Standard operational testing of device 10 is intended to reveal the presence or absence of circuit continuity through the jumper cables, the device being rejected as defective if, for example, one or both cables are inadvertently omitted or defectively connected to the terminals. In conventional devices it is possible that the traces may carry the current for the relatively short interval of testing, thus indicating an operative device even though the jumper cables are omitted or defectively connected. The traces are then likely to be blown out by longer application of higher currents during normal, in-service operation of the device. This problem is obviated by the technique of fabrication of gfi device 10 since only the jumper cables can carry current between the terminals.

One of the ends of the wire of coil 62 is connected to conductive pin 62*a* which extends rigidly from support element 64 through an opening in circuit board 60 for solder connection to the circuit on surface 60*b*. The other end of the coil wire is connected to a conductive pin which is hidden in FIG. 12, but which extends through opening 62*b* in board 60. Short posts 64*a*, integral parts of the plastic molding of element 64, also extend through openings in board 60, as does lower end 106*a* of a conductive pin which is physically incorporated in element 64 during the molding operation and solder-connected in the circuit on surface 60*b*. Upper end 106*b* of this pin extends through separator 84 upon final assembly for contact by test blade leg 100*b* during in-service testing of device 10, as described later.

Integral posts 96*a* and 98*a* extend from line terminals 96 and 98, respectively, through openings in board 60, as does post 98*b* of terminal 98 and a corresponding post (not seen) of terminal 96, the latter posts being solder-connected to respective ends of jumper cables 104, 104'. Block 68*a* is an integral part of the plastic molding which includes cylindrical housing 68. The lower ends of four pins which are molded into block 68*a*, and to which the ends of the windings on cores 72 are respectively connected, extend through openings in board 60 for respective connection on surface 60*b*. The two leads of movister 107, three leads of SCR 108, and the two ends of the conductor carrying resistor 110, likewise extend through openings in board 60 for connection in the circuit on surface 60*b*.

The preferred manner of automated manufacture of device 10 begins with adhesion of the SMD components in their proper positions on surface 60*b*, with this surface facing upwardly. Continuity of trace 104*c* and the trace (not shown) connecting terminals 104*a'* and 104*b'* is broken, as previously described, and SMD jumper cables 104, 104' are adhered by glue dots 105 to surface 60*b*. After sufficient curing of the adhesive, board 60 is mechanically flipped over so that surface 60*a* faces upwardly.

The so-called bobbin and toroid-housing subassemblies are separately fabricated. The bobbin subassembly is prepared by winding coil 62 on the hollow core portion of plastic support element 64, solder-connecting one end of the coil wire to pin 62*a* and the other end to the pin which, after assembly, extends through circuit board opening 62*b*. Armature stem 66*a* is not inserted through the core which is surrounded by coil 62 until later in the operation, as appears hereinafter. Pin 62*a*, the pin to extend through opening 62*b*, and a pin having opposite ends 106*a* and 106*b* are molded or press fitted into plastic support element 64. The toroid-housing subassembly is prepared by inserting pre-wound toroidal cores 72 into housing 68, attaching the ends of the windings to the pins in block 68*a*, placing cover 70 (with integral wall 74) on and affixing it to housing 68, and inserting conducting strips 75, 76 through the openings in cover 70, through toroids 72 in housing 68 and affixing upper portions 75*b*, 76*b* to cover 70 on opposite sides of wall 74 (e.g., by ultrasonic welding of plastic posts extending through openings in portions 75*b*, 76*b* to cover 70).

Figure 17:
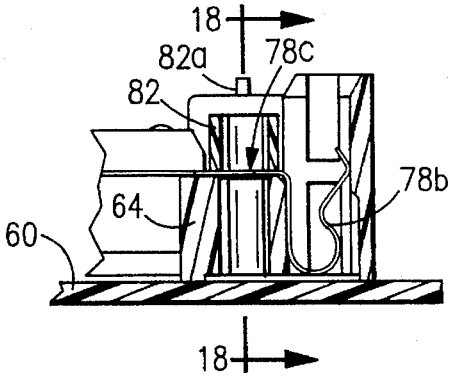
FIG. 17 is an enlarged fragment of FIG. 16.
Figure 18:
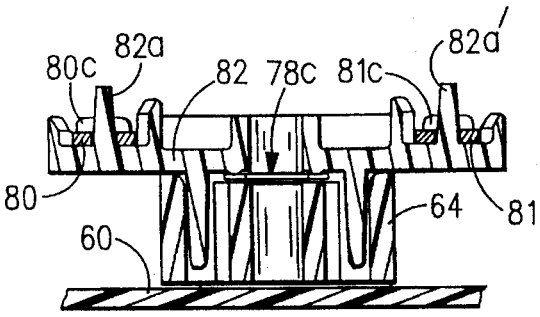
FIG. 18 is an enlarged, fragmentary, elevational view, in section on the line 18—18 of FIG. 17.
Figure 19:
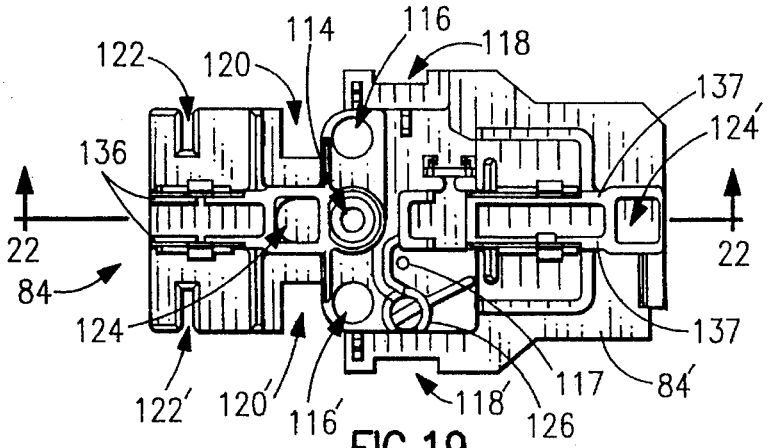
FIG. 19 is s top plan view of a component of the device, termed a separator.
Figure 20:
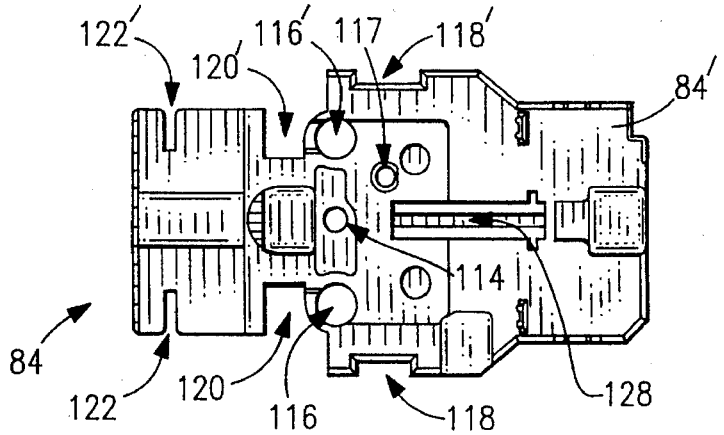
FIG. 20 is a bottom plan view of the separator.
Figure 21:
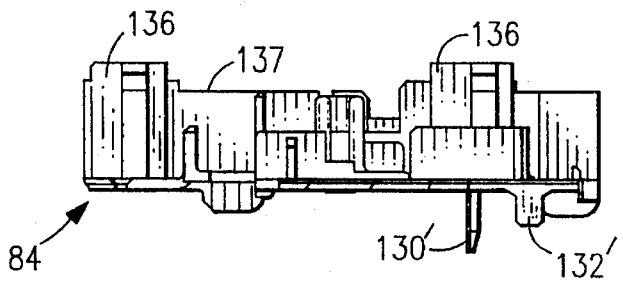
FIG. 21 is a side elevational view of the separator.
Figure 22:
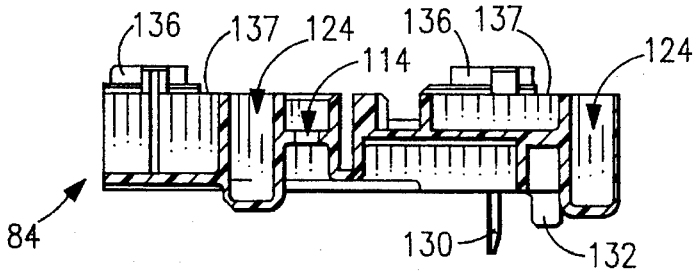
FIG. 22 is a side elevational view in section on the line 22—22 of FIG. 19.

With surface 60*a* facing upwardly, automated assembly proceeds with downward, vertical movement of movistor 107, SCR 108 and resistor 110 (in any desired sequence) to insert the respective leads thereof through the aligned openings in board 60. Armature stem 66*a* is mechanically advanced in a horizontal direction through the plastic core surrounded by coil 62 to complete the bobbin subassembly which is then moved vertically downward to insert posts 64*a*, pin 62*a* and the other coil wire pin, and pin 106*a* through the respective, aligned openings in the circuit board. Latch spring 78, latch block 82 and buss bars 80, 81 are then assembled, in that order, by successive, vertical, downward movement of each into their positions of mutual assembly, best seen in FIGS. 16–18.

The toroid housing subassembly is then moved vertically downward to insert each of the lower ends of conducting strips 75, 76 and the lower ends of the four pins in block 68*a* through aligned openings in circuit board 60. Integral posts 96*a*, 96*b*, 98*a* and 98*b* on line terminals 96, 98 are then inserted through openings in board 60 aligned therewith by vertical, downward movement of the line terminals each carrying one of screws 24 and plates 24*a* in the open slot thereof, This is followed by a soldering operation, connecting all components, leads, pins, terminals, etc. in the required locations on surface 60*b* of board 60.

Figure 15:
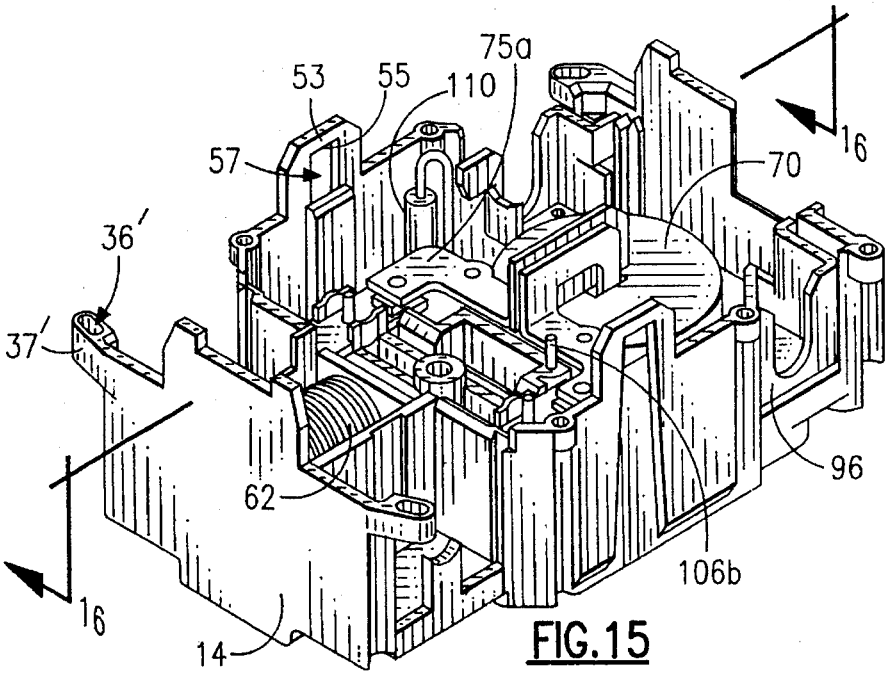
FIG. 15 is a perspective view of the circuit board and components mounted thereon assembled within the rear housing section.
Figure 16:
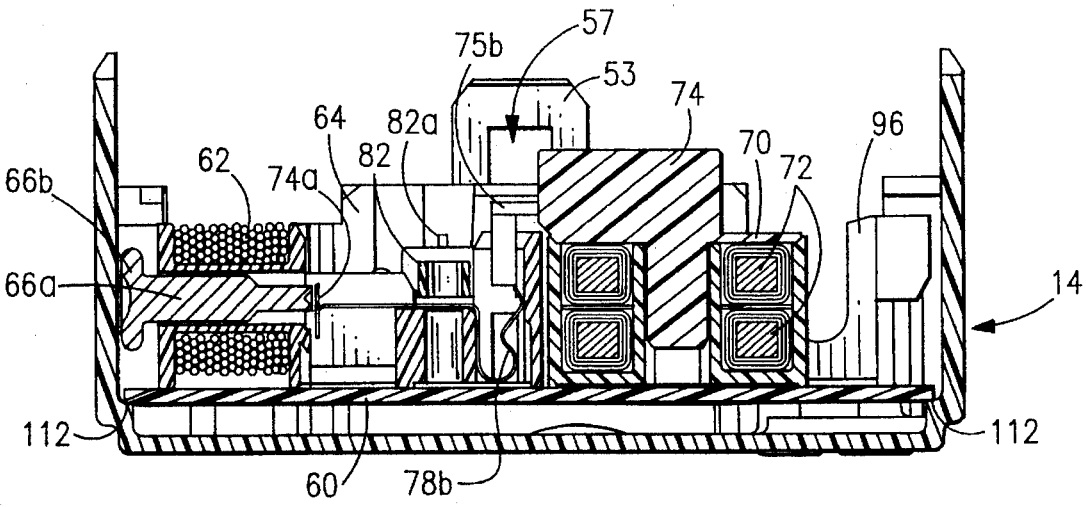
FIG. 16 is a side elevational view in section on the line 16—16 of FIG. 15.

In the next assembly step, rear housing section 14 is placed with its rear (outer) surface facing downwardly, supported on a horizontal surface. Circuit board 60, carrying all of the elements previously assembled as just described, is moved vertically downward, into the space surrounded by the side and end walls of rear section 14, as shown in FIG. 15. The outer periphery of board 60 and the inner periphery of the cavity defined by rear section 14 have complementary configurations to provide close positional constraint of the board. As seen in FIG. 16, edge portions of board 60 are supported on shoulders 112 within housing section 14, providing clearance for the SMD components on surface 60*b*.

Separator 84 is next added to the assembly by vertical, downward movement to position horizontal wall 84*i'* essentially fully covering relation to the elements previously positioned within rear housing section 14. Details of separator 84 are seen in FIGS. 19–22. Through openings 114, 116 and 116' are mutually aligned on a laterally extending axis of separator 84. Upper end 106*b* of the test pin extends through opening 117 upon placement of the separator. A first pair of slots 118, 118', one on each lateral side of the separator, fit closely around vertically extending shoulders 119, 119' (FIG. 10), respectively, on the interior of rear housing section 14. A second pair 120, 120' and a third pair 122, 122' of separator 84, provide clearances for portions of terminals 92 and 94 during assembly thereof, as explained later. Other, unnumbered wall portions on the upper (FIG. 19) side of separator 84 provides guides and supports for terminals 92 and 94.

Cavities 124, 124' are surrounded by wall portions integral to separator 84 along the longitudinal centerline thereof. Cylindrical wall 126 provides a cavity for placement of LED 102. Longitudinal cavity 128 on the lower (FIG. 20) side of separator 84 accepts the upper portions of contact strips 75, 76 and wall 74. A first pair of tabs 130, 130', one on each lateral side, extend downwardly from wall 84', as does a second pair of tabs 132, 132'. Upon placement of separator 84, tabs 130, 130' extend along and provide support for one side of line terminals 96 and 98, respectively, while tabs 132 and 132' extend into the open, upper ends of the slots in the line terminals to define, together with the closed ends of the slots, essentially circular openings surrounding screws 24. Wall portions 136 extend upwardly on opposite sides of portions of horizontal support surfaces 137.

Figure 25:
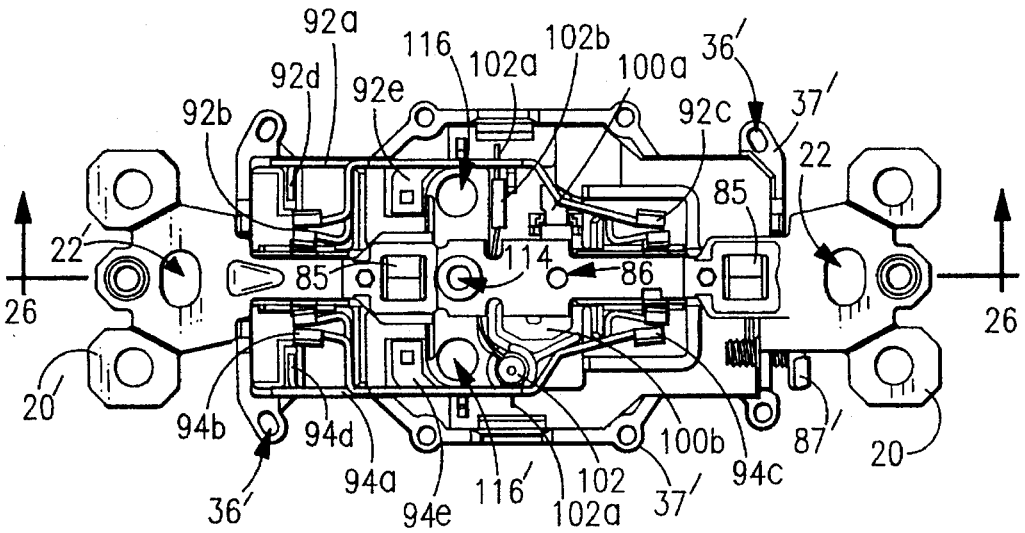
FIG. 25 is a top plan view of the elements as shown in FIG. 24.

With separator 84 in place, LED 102 is moved vertically downward into the cavity defined by wall 126, with leads 102*a* extending laterally outwardly on opposite sides thereof. Test blade 100 is then moved vertically downward into position on separator 84. Load terminals 92 and 94 are next moved vertically downward into assembled relation with the separator and other previously assembled elements. During downward movement of the terminals, arms 92*e* and 94*e* pass through slots 120 and 120', respectively, and tabs 92*d* and 94*d* pass through slots 122 and 122', respectively, as is evident from FIG. 25. Leads 102*a* are firmly engaged between edge portions of the load terminals and the upper surface of wall surface 84', thereby connecting LED 102 across the load side of device 10 without the need for soldered connections of leads 102*a*. Also, leg 100*a* of test blade 100 is engaged between terminal 92 and wall 84', as appears later.

Figure 23:
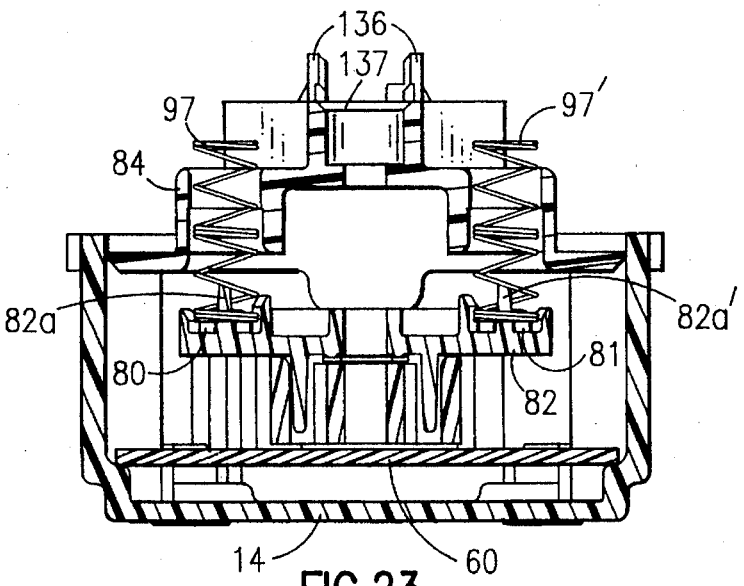
FIG. 23 is an elevational view in section in the position of FIG. 18, with the separator and other elements in assembled relation.

Coil springs 97 and 97' are then moved vertically downward into separator openings 116 and 116', respectively, so that the lower ends of the coils rest upon central portions of buss bars 80 and 81, and surrounding posts 82*a* and 82*a'*, as seen in FIG. 23. The sequence of assembly of load terminals 92, 94 and coil springs 97, 97' may be reversed, if desired.

Figure 24:
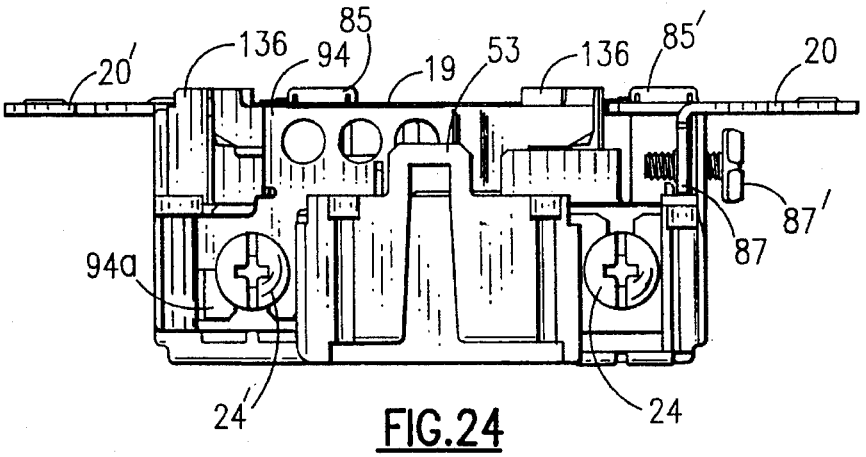
FIG. 24 is a side elevational view, showing further elements in assembled relation.
Figure 26:
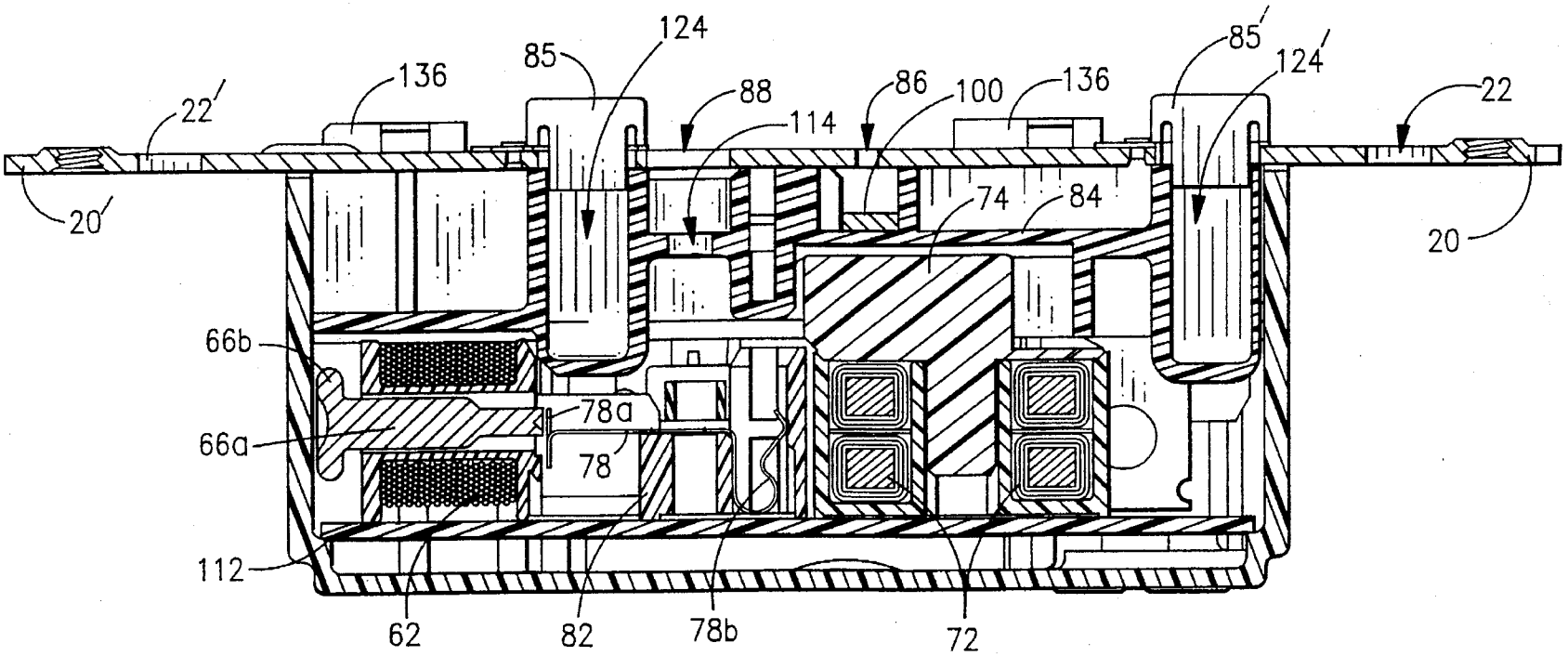
FIG. 26 is a side elevational view in section on the line 26—26 of FIG. 25.

Next, mounting strap 19 is moved vertically downward to rest upon separator support surfaces 137, the strap being laterally constrained by wall portions 136. The elements are now in the positions shown in FIGS. 24, 26, wherein it will be noted that cavities 124 and 124' lie directly beneath ground contacts 85 and 85', respectively, being thus positioned to accept the ground prongs of electrical plugs connected to device 10.

Figure 27:
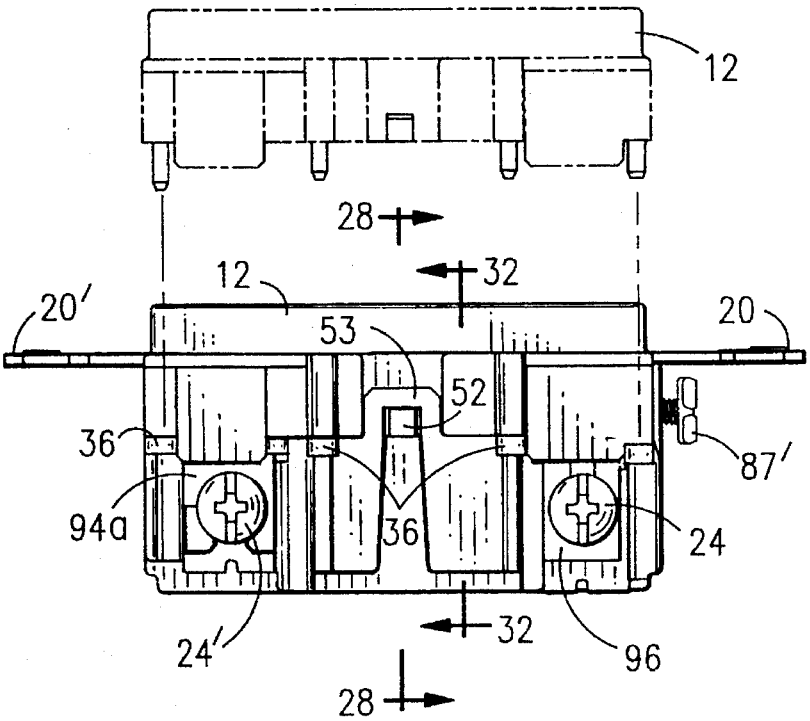
FIG. 27 is a side elevational view showing the manner of assembly of the front housing section with the rear housing section, the latter containing and/or supporting the other components of the receptacle.
Figure 28:
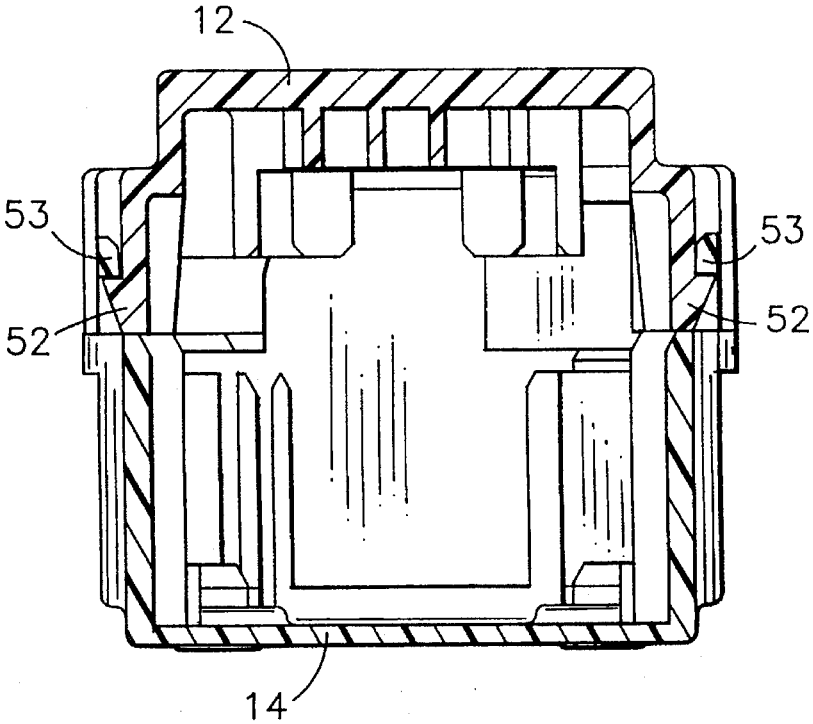
FIG. 28 is an end elevational view in section on the line 28—28 of FIG. 27, illustrating the manner of releasably securing the housing sections in assembled relation.

Front housing section 12 is then positioned above the previously assembled elements, as shown in dotted lines in FIG. 27, and moved vertically downward to the solid line position. During such movement, each of posts 36 passes through a corresponding opening 36', and integral tabs 53 and 53' on rear housing section 14 are deflected outwardly by tapered lugs 52 and 52', respectively, on front section 12. When the front and rear housing sections are fully engaged, they are releasably secured to one another by the snap-fit means of lugs 52, 52' and resilient tabs 53, 53', as previously described. The engagement of lugs 52, 52' under edges 55, 55' of openings 57, 57' of tabs 53, 53' is clearly seen in FIG. 28.

Figure 29:
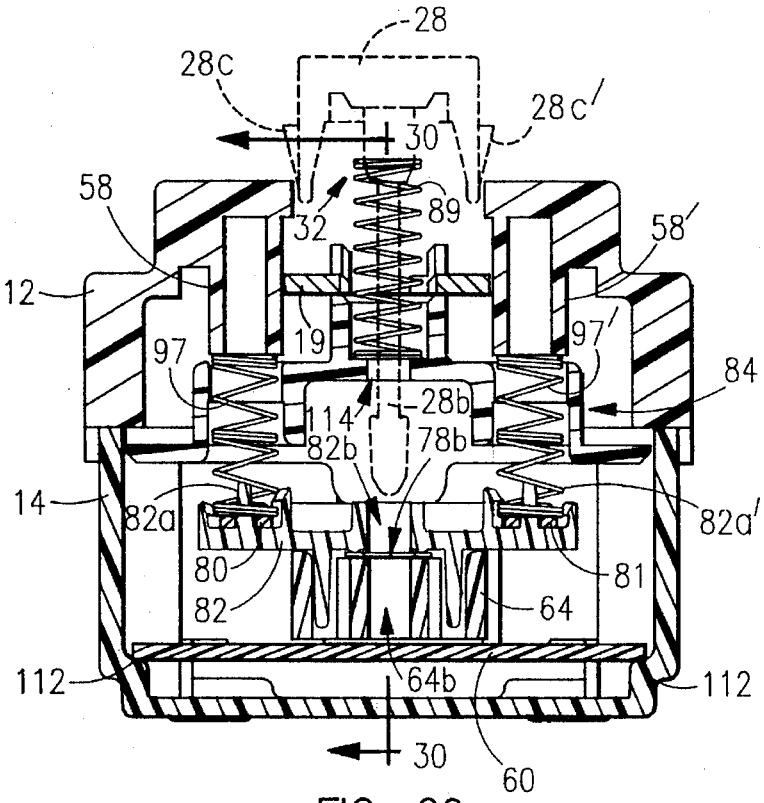
FIG. 29 is an end elevational view in section in the positions of FIGS. 18 and 23 illustrating the manner of assembly of the reset mechanism.

Spring 89 is moved vertically downward along its longitudinal axis, through openings 32 and 88 in front housing section 12 and mounting strap 19, respectively, until its lower end rests upon the portion of separator 84 surrounding opening 114, as seen in FIG. 29. It will also be noted from this Figure that in the mutually assembled relation of the front and rear housing sections, the free ends of towers 58 and 58' bear against the upper ends of coil springs 97 and 97', respectively, thus compressing the springs between fixed towers 58 and 58' at their upper ends and moveable buss bars 80 and 81 at their lower ends.

Reset button 28 is then moved vertically downward to extend stem 28*a* through springs 89, as indicated in dotted lines in FIG. 29. It will be noted from this and other Figures that integral, resilient tabs 28*c*, 28*c'* are positioned in openings in opposite end walls of button 28. Tabs 28*c*, 28*c'* are integral with the end walls of the button along the lower sides of the openings and have outer surfaces which taper outwardly toward the top of the button. The dimensions of button 28, 28*c*, 28*c'* and opening 32 are such that the tabs are deflected inwardly by the edges of the opening as the button is moved downwardly. When the stepped shoulders at the free ends of tabs 28*c* and 28*c'* have cleared the lower edges of opening 32, the natural resilience of the tabs moves them back to their normal, outward positions and button 28 is captured within openings 32.

As reset button 28 is inserted, the free end of stem 28*a*, after passing through spring 89, opening 88 in strap 19, and opening 114 in separator 84, passes through opening 82*b* in latch block 82 and opening 78*c* in latch spring 78, extending into cavity 64*b* of support member 64. Spring 89 biases reset button 28 toward upward movement which is limited by contact of the free ends of tabs 28*c*, 28*c'* with the internal surface portions of housing section 12 adjoining the ends of opening 32.

To place the elements of device 10 in normal operating position, button 28 is manually depressed to move shoulder 28*b*, past the edge of latch spring 78 which adjoins opening 78*c*. During this movement, latch spring 78 will be moved slightly toward the right, as viewed in FIG. 30, compressing leaf spring 78*b* within its cavity in support member 64. When shoulder 28*b*, moves below latch spring 28, the latter is moved back toward the left by the biasing force of leaf spring 78*b* and the reset button stem is engaged with the latch spring.

Figure 30:
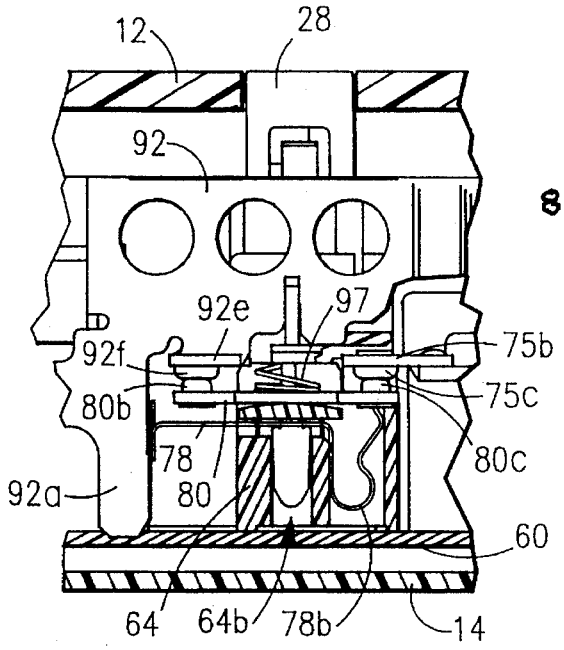
FIGS. 30 and 31 are fragmentary, elevational views in section on the line 30—30 of FIG. 29, showing the positions of the elements with the moveable contacts engaged and disengaged, respectively, with the fixed contacts.

When manual pressure is removed from reset button 28, spring 89 moves the button back in the upward direction. Due to the engagement of shoulder 28*b*, with latch spring 78, the latter is also moved upwardly, together with latch block 82 and buss bars 80 and 81. This further compresses coil springs 97 and 97', meaning of course that the biasing force of spring 89 exceeds the combined biasing forces of springs 97 and 97'. Upward movement of the elements places contact 80*b* on buss bar 80 in engagement with contact 92*f* on the lower side of load terminal arm 92*e*, and contact 80*c* in engagement with contact 75*c* on the lower side of portion 75*b* of line contact 75, as shown in FIG. 30. Of course, contacts 81*b* and 81*c* of buss bar 81 are also moved into engagement with corresponding contacts on load terminal 94 and line contact 76. When the contacts are so engaged, the free ends of reset button tabs 28*c* are spaced from (below) the opposing, internal surface portions of front housing section 12. Thus, electrical communication between the line and load sides of device 10 is established for both the hot and neutral conductors through buss bars 80 and 81.

Figure 30A:
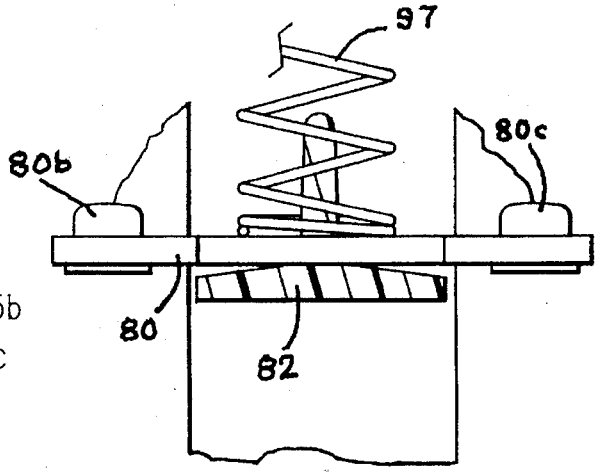
FIG. 30*a* is an enlarged, fragmentary, elevational view in section on the line 30*a*—30*a* of FIG. 29.

FIG. 30*a* illustrates in greater detail the configuration of the upwardly facing surfaces of latch block 82 upon which bias bars 80 and 81 are carried. It will be noted that the surface beneath buss bar 80 slopes downwardly from the center toward each end. Thus, the lower surface of the buss bar is supported essentially only across the mid-point between the positions of contacts 80*b* and 80*c*. This configuration ensures that both of the moveable contacts will be fully engaged with the fixed contacts, compensating for any misalignment which might occur due to opposing planar surfaces being non-parallel.

An imbalance in current flow through the hot and neutral conductors is sensed by toroidal cores 72 and their associated windings. Through the operation of conventional gfi circuitry, the current imbalance energizes coil 62, moving armature 66 and latch spring 78 toward the right. Contact of the free end of stem 66*a* with abutment portion 78*a* moves latch spring 78 to the right, from the position of FIG. 30 to the position of FIG. 31, compressing leaf spring 78 and disengaging the latch spring from shoulder 28*b*, on reset button stem 28*a*.

Figure 31:
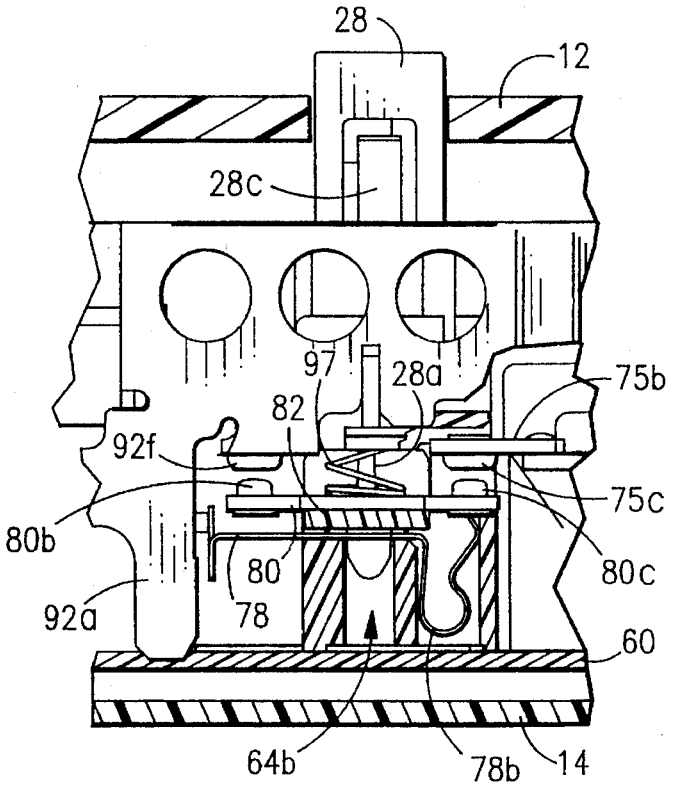

Upon disengagement of latch spring 78 and shoulder 28*b*, spring 89 moves reset button 28 upwardly until the free ends of tabs 28*c* contact internal surface portions of housing section 12 on opposite sides of opening 32. At the same time, the biasing forces of coil springs 97 and 97' move buss bars 80 and 81 downwardly, moving both contacts of both buss bars out of engagement with the corresponding line and load terminal contacts, thereby deenergizing coil 62, allowing armature 66 and latch spring 78 to return to their positions of FIG. 30. As shown in FIG. 31, both contacts 80*b* and 80*c* are spaced from contacts 92*f* and 75*c*, respectively. Thus, circuit continuity between the line and load sides of device 10 is interrupted by a ground fault or other potentially dangerous condition. The elements may be returned to their positions of normal operation by manual depression of reset button 28, as previously explained.

Figure 32:
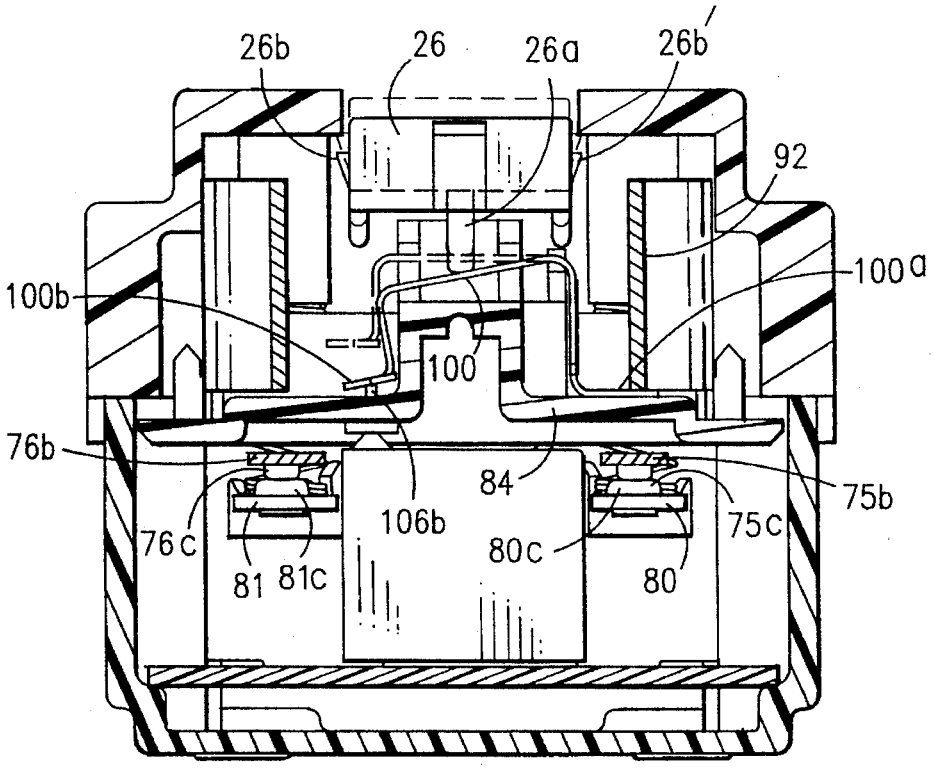
FIG. 32 is an elevational view in section on the line 32—32 of FIG. 27, illustrating the manner of assembly and operation of the test mechanism.

After (or before, if desired) reset button 28 is assembled with device 10, test button 26 is moved vertically downward, into opening 30, as seen in FIG. 32. Resilient tabs 26*b*, 26*b'* in opposite end walls of test button 26 are deflected inwardly as the button is inserted and return to their outer positions to capture the button in opening 30 in essentially the same manner as tabs 28*c*, 28*c'* on reset button 28. Leg 100*a* of blade 100 is firmly engaged between an edge of load terminal 92 and the upper surface of separator wall 84', as previously mentioned.

Blade 100 is constructed of electrically conducting, springy sheet metal in a configuration such that it assumes the position shown in dotted lines in FIG. 32. In this position, a medial portion of blade 100 contacts stem 26*a* and maintains button 26 in its dotted line position, with the free ends of tabs 26*b*, 26*b'* contacting the internal surface portions adjacent the ends of opening 30 in housing section 12. Manual depression of button 26 moves test blade 100 to the solid line position of FIG. 32, bringing leg 100*b* into contact with pin end 106*b* and placing the pin in electrical communication with terminal 92. This has the effect of simulating a fault in the line and, if device 10 is operating properly, results in the previously described operation to interrupt the circuit. Upon removal of manual pressure from test button 26, the parts return to the dotted line positions of FIG. 32 and reset button 28 may be depressed to restore circuit continuity in the manner previously described.

After placement of the reset and test buttons, assembly is complete and device 10 is ready for testing. Such tests are standard in the industry although some variations may be employed. Wires are connected, via the four screws exposed on the exterior of the device, to the hot and neutral terminals on both the line and load sides. The normal operating voltage of the device (e.g., 120 Vac) is applied to the line terminals, first with a fault current slightly below the intended actuating level, and then with a fault current slightly exceeding that level, which should result in non-actuation and actuation, respectively. These tests are repeated at full load, and other tests, e.g., for grounded neutral actuation, noise voltage non-actuation, and acceptable actuating time upon application of a 500 ohm ground fault are also performed.

Figure 33:
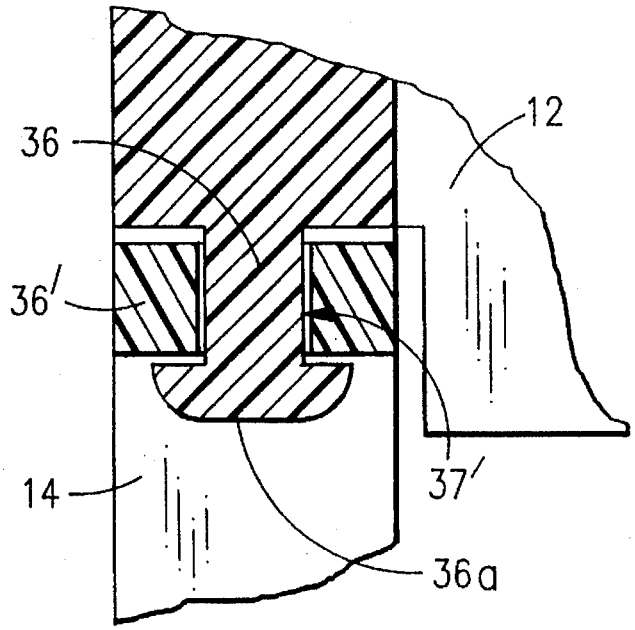
FIG. 33 is a fragmentary, enlarged elevational view, in section, illustrating the manner of permanent connection of the housing sections.

If device 10 fails any of the prescribed tests, it may be disassembled by removing the releasable connection of housing sections 12 and 14 in the manner previously described to repair the defect. If testing is satisfactory, the housing sections are then permanently connected to one another by ultrasonic deformation of the free ends of posts 36 of front section 12 which extend through openings 37' of rear section 14. This has the effect of creating a mechanical, riveted connection between the housing sections with enlarged portion 36*a* acting as a rivet head, as shown in FIG. 33.

Figure 34:
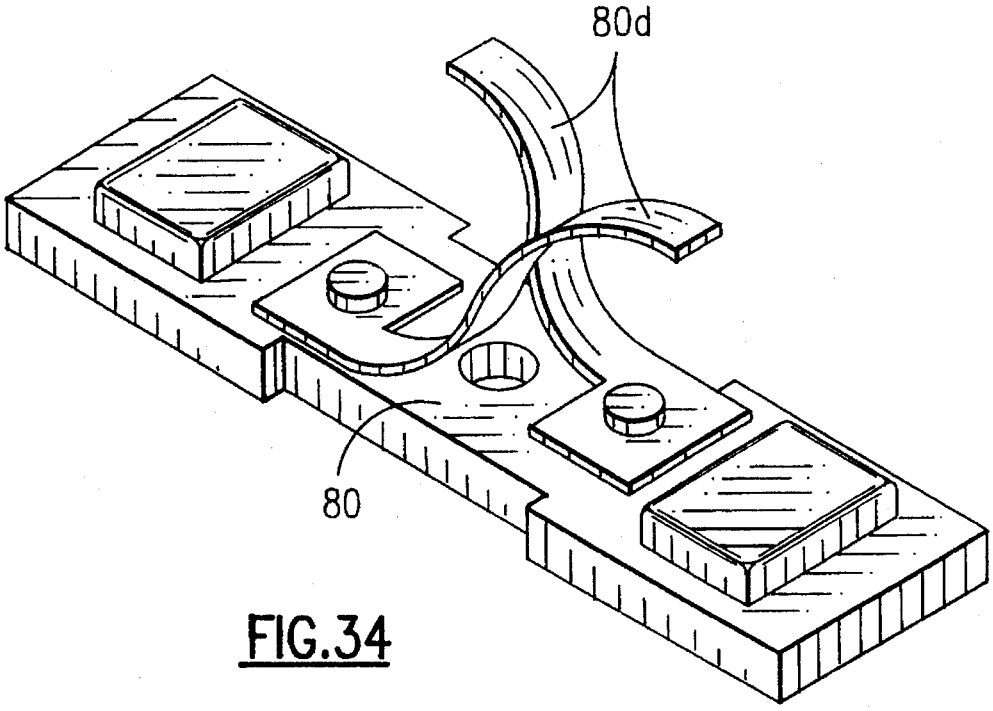
FIGS. 34 and 35 are perspective views of alternate embodiments of certain elements.
Figure 35:
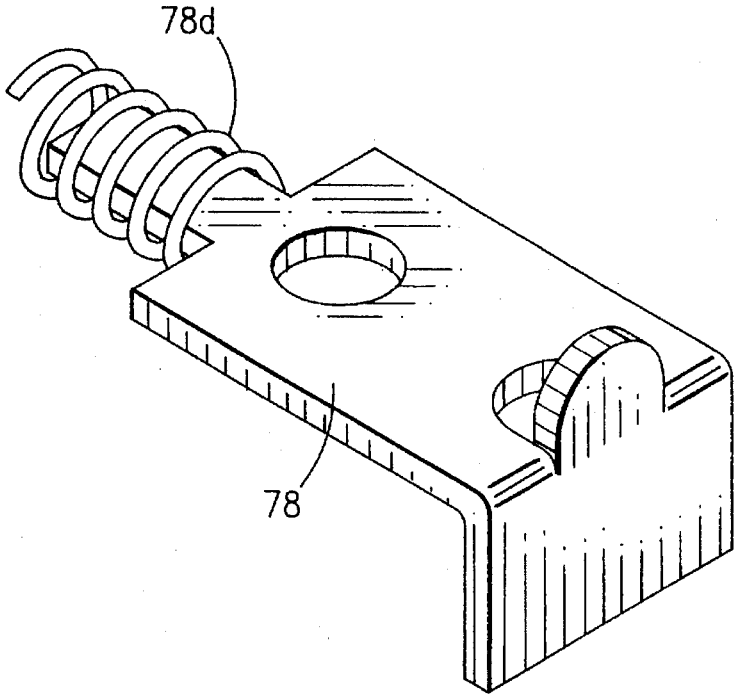
Figure 36:
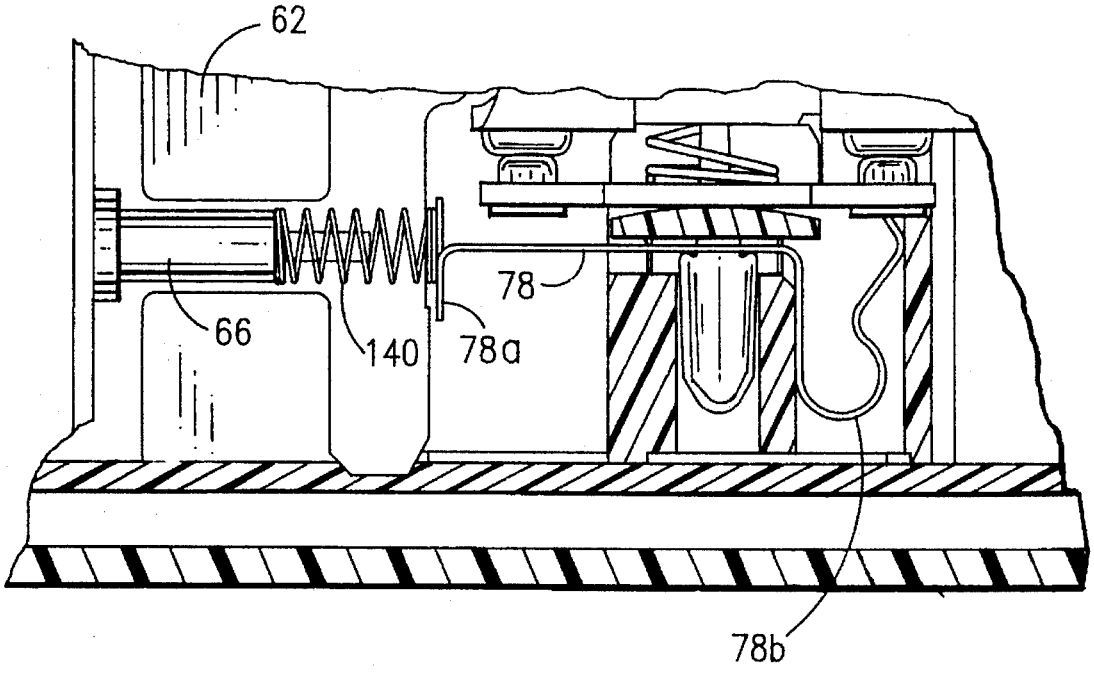
FIG. 36 is a side elevational view of another alternate embodiment.

While the previously described configurations, relative positioning and manner of assembly of the elements represent the presently preferred embodiment, it will be understood that variations in certain details are possible within the scope of the invention. Examples of some of the many possible variations are illustrated in FIGS. 34–36. As shown in FIG. 34, leaf springs 80*d* are attached to (or formed integrally with) buss bar 80. Springs such as leaf springs 80d would replace coil springs 97, 97' and provide the biasing force for movement of buss bars 80, 81 to break circuit continuity. FIG. 35 shows an end portion of latch spring 78 carrying coil spring 78*d*, which would replace leaf spring 78*b* and provide the biasing force for latch spring 78. Rather than compressing coil spring 97, 97' (or springs substituted therefor) between the buss bars and interior portions of front housing section 12, such springs could be compressed between the buss bars and portions of the separator. In any case, all parts are so configured that, after separate preparation of bobbin and toroid housing subassemblies, device 10 may be assembled by fully automated means since all parts are placed in assembled relation by downward, vertical movement.

Coil spring 140 is added in the FIG. 36 modification to maintain the terminal end of solenoid armature 66 in spaced relation to abutment portion 78*a* of latch spring 78 when coil 62 is deenergized. All components other than coil spring 140 have the same construction, positional relationships of operation as previously described. Coil spring 140 is weaker than leaf spring 78*b* of latch spring 78 whereby, upon energization of solenoid coil 62, armature 66 moves to compress spring 140 before contacting abutment portion 78*a*. This has the advantageous effect of increasing the momentum of armature 66 prior to contact thereof with the latch spring, thereby improving the circuit-interrupting operation of device 10. Without spring 140, the end of armature 66 may be in contact with abutment portion 78*a* before energization of coil 62, depending upon the physical orientation of device 10. Thus, the improved performance provided by inclusion of spring 140 may offset the increase in cost occasioned thereby.

Thus, the present invention provides a gfi wiring device having a unitary latch member including integral abutment, latching and spring portions, thereby simplifying construction and assembly of the device. The solenoid actuating mechanism is also improved by providing an enlarged head portion on the armature in axially spaced relation to one end of the coil to provide enhanced reaction of the armature to the electromagnetic flux field generated by the coil. The enlarged head portion preferably has a cross sectional area in a plane perpendicular to the axis of the coil opening at least 1.25 times the cross sectional area of the opening. Also, in the usual case of the coil and armature head both being cylindrical, the diameter of the head is at least ⅔ the outer diameter of the coil. As a further refinement, auxiliary spring means may be provided to ensure that the contact end of the armature is spaced by a predetermined distance from the abutment portion of the latch member prior to energization of the coil, thereby maximizing momentum of the armature when it contacts and moves the latch member.

What is claimed is:

1. A unitary latch member for releasably maintaining a moveable contact of a ground fault interrupter wiring device in a predetermined position with respect to a fixed contact, said latch member having opposite end portions and comprising:

a) an abutment portion at one of said ends;

b) a spring portion at the other of said ends compressible to urge said latch member toward movement in the direction of said one end; and c) an engagement portion intermediate of said ends for releasable engagement with another portion of said device to temporarily maintain said latch member in a predetermined position.

2. The latch member of claim 1 wherein said abutment, spring and engagement portions are all integrally formed from a single sheet of material.

3. The latch member of claim 2 wherein said material is resilient sheet metal and said spring portion is a leaf spring.

4. The latch member of claim 1 wherein said abutment and spring portions are joined by an intermediate portion and said engagement portion comprises an edge portion of said intermediate portion.

5. The latch member of claim 4 wherein said abutment and intermediate portions are substantially flat and lie in substantially perpendicular planes.

6. The latch member of claim 1 wherein said spring portion is a coil spring having a central axis.

7. The latch member of claim 6 wherein said abutment portion is substantially flat and lies in a plane substantially perpendicular to said central axis.

8. A ground fault interrupter (gfi) wiring device for connection in an electrical circuit, said device comprising:

a) housing means of dielectric material defining an enclosed space;

b) at least one first contact fixedly positioned within said enclosed space;

c) at least one second contact within said enclosed space for movement with respect to said fixed contact between a first position, in circuit-making engagement with said first contact, and a second position, in spaced, circuit-breaking relation to said first contact;

d) a unitary latch member having an abutment portion, a first engagement portion and a spring portion, said latch means being mounted within said enclosed space for reciprocal movement in first and second, opposite directions along a first axis, and in third and fourth, opposite directions along a second axis, transverse to said first axis, said spring portion urging said latch member toward movement in said third direction;

e) a moveable member mounted within said enclosed space for movement in said first and second directions, and having a second engagement portion with which said first engagement portion is engaged and disengaged by movement of said latch member in said third and fourth directions, respectively;

f) said latch member and said second contact being constructed and arranged for movement of said second contact to said first position by movement of said latch member in said first direction;

g) first biasing means for moving said second contact to said first position when said first and second engagement portions are mutually engaged;

h) second biasing means for moving said second contact said second position upon disengagement of said first and second engagement portions by movement of said latch member in said fourth direction; and i) actuating means moveable in response to a sensed fault condition in said circuit to move said latch member in said fourth direction.

9. The gfi device of claim 8 wherein said spring portion comprises a coil spring having a central axis oriented in said third and fourth directions.

10. The gfi device of claim 9 wherein said abutment portion is substantially flat and lies in a plane substantially perpendicular to said central axis.

11. The gfi device of claim 8 wherein said abutment, first engagement and spring portions are all integrally formed from a single sheet of material.

12. The gfi device of claim 11 wherein said material is springy sheet metal and said spring portion is a leaf spring.

13. The gfi device of claim 8 wherein said second contact is carried by an electrically conducting member and said second biasing means urges said electrically conducting member toward movement in a direction moving said second contact to said second position.

14. The gfi device of claim 13 wherein said second biasing means is a coil spring.

15. The gfi device of claim 13 wherein said second biasing means is a leaf spring.

16. The gfi device of claim 8 wherein said moveable member comprises a reset member having a manually engageable portion and a stem portion.

17. The gfi device of claim 16 wherein said second engagement portion comprises a shoulder on said stem portion.

18. The gfi device of claim 17 wherein said first biasing means comprises a spring urging said reset member toward movement in said first direction.

19. The gfi device of claim 8 wherein said actuating means comprises a solenoid having a coil and a moveable armature, and means for energizing said coil to move said armature in said fourth direction in response to said sensed fault condition.

20. The gfi device of claim 19 and further comprising spring means for maintaining said armature in spaced relation to said abutment portion prior to energization of said coil.

21. A ground fault interrupter (gfi) wiring device for connection to hot and neutral lines in an electrical circuit, said device comprising:

a) housing means of dielectric material defining an enclosed space;

b) a pair of first contacts fixedly positioned within said enclosed space;

c) a pair of second contacts positioned within said enclosed space for movement conjointly between a first position, in respective, circuit-making engagement with said first pair of contacts, and a second position, in spaced, circuit-breaking relation to said first pair of contacts;

d) first spring means urging said second contacts toward movement to said second position thereof;

e) a unitary latch member including an abutment portion, a first engagement portion and second spring means, said latch member being mounted within said enclosed space for reciprocal movement in a first path between latching and unlatching positions, and in a second path, transverse to said first path, between opposite, terminal positions, said second spring means urging said latch member toward movement along said first path to said latching position;

f) a reset member including a surface accessible exteriorly of said housing means for manual movement of said reset member in a first direction, and a second engagement portion with which said first engagement portion is engaged to maintain said second contacts in said first position when said latching member is in said latching position;

g) third spring means urging said reset member toward movement in a second direction, opposite to said first direction; and h) actuating means moveable in response to an imbalance of current flow in said hot and neutral lines to move said latching member from said latching to said unlatching position, thereby permitting movement of said second contacts to said second position thereof and said reset member in said second direction.

22. The gfi device of claim 21 wherein said second spring means comprise a leaf spring.

23. The gfi device of claim 22 wherein said latch member has opposite ends said leaf spring and said abutment portion are respectively formed at said opposite ends.

24. The gfi device of claim 23 wherein said first engagement portion is formed at a position intermediate of said opposite ends.

25. The gfi device of claim 24 wherein said first engagement portion comprises a portion adjoining an opening in said latch member.

26. The gfi device of claim 25 wherein said reset member further comprises an elongated stem extending through said latch member opening, and said second engagement portion comprises a shoulder on said stem.

27. The gfi device of claim 22 wherein said first spring means comprises at least one coil spring.

28. The gfi device of claim 27 wherein said third spring means comprise a single coil spring independent of said at least one coil spring.

29. The gfi device of claim 21 wherein said actuating means comprise a solenoid having an armature reciprocally moveable in a direction parallel to said first path and having an end portion engageable with said abutment portion to move said latch member to said unlatching position.

30. The gfi device of claim 29 wherein said latch member has opposite ends, said abutment portion being integrally formed at one of said ends.

31. The gfi device of claim 30 wherein said second spring means comprises a leaf spring integrally formed at the end of said latch member opposite said one end.

32. The gfi device of claim 31 wherein said latch member is formed from a unitary piece of springy sheet metal.

33. A ground fault interrupter (gfi) wiring device for connection to hot and neutral lines of an electrical circuit and for opening said circuit in response to an imbalance of current flow through said hot and neutral lines, said device comprising:

a) housing means defining an enclosed space;

b) at least one first electrical contact fixedly mounted within said enclosed space;

c) at least one second electrical contact mounted within said enclosed space for movement between a first position, in circuit-making engagement with said first contact, and a second position, in spaced, circuit-breaking relation to said first contact;

d) spring means compressible to apply a biasing force urging said second contact toward said second position;

e) latch means for releasably holding said second contact in said first position;

f) means for sensing an imbalance of current flow through said hot and neutral lines;

g) a solenoid including a coil wound symmetrically about a central axis surrounded by an opening having an internal wall extending axially through said coil, and a magnetically permeable armature having an elongated stem portion extending slideably through and closely surrounded over at least a portion of its length by internal wall between a terminal end on one side of said coil and a relatively enlarged head portion integral with said stem portion on the other side of said coil, said head portion having a cross section in a plane perpendicular to said axis at least 1.25 times the cross section of said opening;

h) means for releasing said latch means in response to movement of said armature in a first direction from said head portion to said terminal end; and i) means for energizing said coil to generate a magnetic flux field in response to said imbalance of current flow to effect movement of said armature in said first direction, the speed of said movement being enhanced by said magnetic flux field acting upon said relatively enlarged head portion.

34. The gfi device of claim 33 wherein said latch means comprises a latch member moveable in said first direction from a latching to a releasing position.

35. The gfi device of claim 34 wherein said latch member includes an abutment portion engageable by said terminal end of said stem portion to effect movement of said latch member to said releasing position in response to movement of said armature in said first direction.

36. The gfi device of claim 35 and further including biasing means maintaining said terminal end in spaced relation to said abutment portion prior to energization of said coil.

37. The gfi device of claim 36 wherein said biasing means comprises a spring interposed between said stem portion and said abutment portion.

38. The gfi device of claim 35 wherein said latch member further includes an integral leaf spring biasing said latch member against movement to said releasing position.

39. The gfi device of claim 38 wherein said latch member has opposite ends and said abutment portion is formed at one and said leaf spring at the other of said ends.

40. The gfi device of claim 33 wherein said coil is mounted between first and second walls of dielectric material perpendicular to said coil axis, said head and said terminal end of said stem portion being positioned on opposite sides of respective ones of said walls from said coil.

41. The gfi device of claim 33 wherein said coil has a circular outer periphery of substantially uniform diameter throughout its length, and said head portion has a circular outer periphery of a diameter at least ⅔ of said uniform diameter.

* * * * *